US005234798A

United States Patent [19]

Heninger et al.

[11] Patent Number: 5,234,798

[45] Date of Patent: Aug. 10, 1993

[54] THERMAL REACTIVE STRUCTURES

[75] Inventors: Byrne E. Heninger, Gainesville; Donna C. Stimpson, Loganville; Stephen M. Ems, Flowery Branch, all of Ga.

[73] Assignee: Dittler Brothers, Incorporated, Atlanta, Ga.

[21] Appl. No.: 771,482

[22] Filed: Oct. 4, 1991

[51] Int. Cl.[5] ..... G03C 1/73

[52] U.S. Cl. ..... 430/340; 430/292; 430/332; 430/495; 430/964; 428/29; 428/199; 503/200

[58] Field of Search ..... 430/273, 340, 346, 14, 430/21, 199, 292, 332, 320, 334, 964, 495; 428/29, 199; 503/200

[56] References Cited

U.S. PATENT DOCUMENTS

| | | | |
|---|---|---|---|
| 630,255 | 8/1899 | Morrow | 283/67 |
| 736,035 | 8/1903 | Stevenson | 283/95 |
| 1,167,566 | 1/1916 | Jenkins | 283/94 |
| 3,001,886 | 9/1961 | Shrewbury et al. | 428/199 |
| 3,129,109 | 4/1964 | Workman | 430/346 |
| 3,242,122 | 3/1966 | Cheng | 430/334 |
| 3,887,808 | 6/1975 | Van den Houte et al. | 430/346 |
| 4,175,774 | 11/1979 | Tonges et al. | 283/6 |
| 4,180,405 | 12/1979 | Lawton | 503/216 |
| 4,287,285 | 9/1981 | Mosehauer | 430/124 |
| 4,407,443 | 10/1983 | McCorkle | 383/5 |
| 4,488,646 | 12/1984 | McCorkle | 206/459 |
| 4,500,116 | 2/1985 | Ferro et al. | 283/92 |
| 4,579,370 | 4/1986 | Corwin et al. | 283/72 |
| 4,627,819 | 12/1986 | Burrows | 434/337 |
| 4,677,553 | 6/1987 | Roberts | 364/412 |
| 4,738,472 | 4/1988 | Shibata | 283/101 |
| 4,833,311 | 5/1989 | Jalon | 235/491 |
| 4,850,618 | 7/1989 | Halladay, Jr. | 283/94 |
| 4,863,783 | 9/1989 | Milton | 428/207 |
| 5,098,882 | 3/1992 | Teraji et al. | 503/209 |
| 5,153,104 | 10/1992 | Rossman et al. | 430/339 |
| 5,153,105 | 10/1992 | Sher et al. | 430/339 |

*Primary Examiner*—Charles L. Bowers, Jr.
*Assistant Examiner*—John A. McPherson
*Attorney, Agent, or Firm*—Kilpatrick & Cody

[57] ABSTRACT

Structures for items such as promotional materials, game pieces, lottery tickets, security documents and other articles, which feature one or more thermal reactive layers that are activated by heat from a hidden image formed of infrared sensitive, heat generating material such as carbon black preprinted under the thermal reactive layers during manufacture. The thermal reactive layers permit transmission of radiant energy such as infrared to the heat generating, hidden layers. The heated image conducts heat to the thermal reactive layers which employ a coloring agent and a developer which, when exposed to the heat, react or act in concert in order to form a corresponding image on the face of the item.

12 Claims, 2 Drawing Sheets

THERMAL REACTIVE STRUCTURES

The present invention relates to articles and structures which are transformed to show a previously hidden image upon exposure to radiant energy such as infrared.

BACKGROUND OF THE INVENTION

Conventional techniques have been used for preparing articles featuring images which are revealed or formed by heat or light energy after manufacture. U.S. Pat. No. 736,035 to Stevenson, for instance, discloses an article featuring an image with a cover print layer, which print layer becomes transparent after exposure to light to reveal the image. U.S. Pat. No. 1,167,566 to Jenkins discloses similar techniques for railway transfer tickets.

Other techniques involve thermosensitive layers formed of leuco dyes, acids and/or other materials, which change color when exposed to heat or steam in order to betray tampering with or "candling" lottery tickets and other particles. U.S. Pat. No. 4,738,472 to Shibata discloses a label with such a layer that discolors upon attempts to remove the label using heat or steam. Similarly, U.S Pat. Nos. 4,407,443 and 4,488,646 to McCorkle disclose blush coatings for lottery tickets which betray exposure to solvents or heat. Polymeric molecules in those coatings coalesce and become more compact and thus more translucent to reveal such abuse.

In a similar vein, game pieces, lottery tickets and similar materials have been marketed with thermosetting layers covered by, among other layers, scratch off layers. According to U.S. Pat. No. 4,677,553 to Roberts, et al., for instance, a thermal printer at point of sale fixes information in such a thermosetting varnish coat, which may be subsequently exposed by removing the scratch off layer with a coin or a fingernail. U.S. Pat. No. 4,850,618 to Halliday similarly discloses lottery tickets which include thermally sensitive materials covered by one or more ruboff layers, which, as in the Roberts patent, may be printed at point of sale using a thermal printer and then revealed to the customer upon removal of the ruboff layer.

In addition, many techniques and processes exist for the preparation of thermally sensitive paper sometimes used in thermal printers for personal computers, copier machines and telecopy machines and similar devices. Such thermal papers may employ leuco, diazo, or metallic dyes or coatings. One typical system employs a leuco dye evenly dispersed in a binder with a developer material. The leuco dye and developer fuse or react to generate an image when exposed to the thermal printing head.

The inventors are aware of third party promotion of the concept of game pieces which may be exposed to a flash of light at point of sale in order to produce an image, and which employ the idea of a thermally sensitive image layer placed over an infrared-sensitive layer for this purpose.

SUMMARY OF THE INVENTION

The present invention uses flexographic, lithographic, gravure, offset, and other commercial printing techniques for applying a succession of layers that produce images upon exposure to radiant energy. Those layers include one or more thermal reactive layers which are activated by heat from a hidden image formed of infrared sensitive material such as carbon black or iron oxide. The thermal reactive layer permits transmission of radiant energy such as infrared to the infrared sensitive layer, whose temperature is elevated (for purposes of this document, "generates heat"). The heated image conducts heat to the thermal reactive layer which includes a coloring agent and a thermal developer which, when exposed to the heat, react or act in concert in order to form a corresponding image that becomes apparent to the viewer.

The various thermal imaging layers, heat generating layers, obscuration layers, overprint layers and other layers are formulated according to the present invention to be applied efficiently and effectively using conventional commercial equipment such as flexographic, lithographic, gravure, offset, ink-jet and other conventional equipment. For instance, the thermal imaging layer must exhibit appropriate stability, flow, thickness, drying time, viscosity, friction coefficient, color and foaming characteristics and parameters, among others, in order to be compatible with such processes. Yet, the components of that layer must also collectively yield light-sensitivity, durability, heat, humidity and stain resistance, and aesthetic properties that are necessary for the commercial success of commercial game pieces, security documents and other such items. Each layer must also, however, function properly with the other layers to provide an acceptable product; for example, each layer must adhere properly to its neighboring layers in order to avoid flaking, separation, or other mechanical defects. The inventors have developed processes, compositions and structures of the present invention which accommodate these requirements, as discussed below.

In one embodiment, such a structure features the image layer formed of carbon black, at least one obscuration layer applied over the image layer, and at least one thermal reactive layer. In another embodiment, the structure may include a sizing layer placed on the substrate or stock, at least one image layer, at least one obscuration layer formed of inks of the three primary colors (so as to appear black, but yet to allow penetration by radiant energy), at least one layer of overprint to mask the hidden image and obscuration layers, and at least one thermal reactive layer.

The coloring agent used in the thermal reactive layer is preferably one that is oxidized in the presence of a thermal developer, and wherein the oxidation/reduction reaction is initiated by heat. An example of such a coloring agent is a leuco dye which acts in conjunction with a oxidizing agent in the form of a developer which is preferably a thermal developer. The leuco dye acts as an electron donor and the developer as an electron acceptor, causing ionization and coloration of the leuco dye upon exposure to heat.

Coloring agents are defined as those colorless or slightly colored compounds which form intense color when combined with a thermal developer and radiant energy is applied. Suitable agents for purposes of the present invention include (but are not limited to) conventional coloring agents used in thermographic printing such as leuco dyes, including but not limited to triphenylmethane leuco compounds (see structure below), fluoran leuco compounds (see structure below), known phenothiazine-based leuco dyes, auramine and known auramine derivatives that are used as leuco dyes and spiropyran-based leuco compounds. Leuco dyes are dyes usually in colorless or slightly colored form which, when oxidized, become colored.

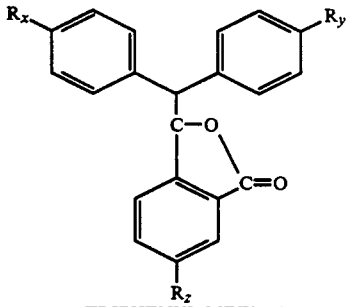

TRIPHENYL METHANE TYPE

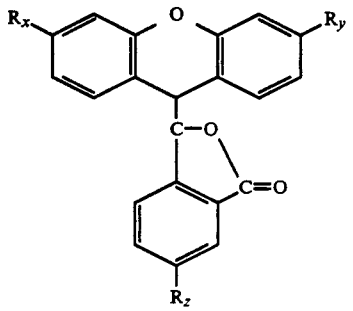

FLUORAN TYPE $R_x$, $R_y$, $R_z$ are hydrogen, halogen, hydroxyl, alkyl, nitro, amino, dialkylamino, monoalkylamino or aryl groups. Suitable leuco dyes include:

3-diethylamino-7-o-chloroanilinofluoran
3-diethylamino-7-m-chloroanilinofluoran
3-diethylamino-7-p-chloroanilinofluoran
3-di(n-butyl)amino-7-o-chloroanilinofluoran
3-di(n-butyl)amino-7-m-chloroanilinofluoran
3-di(n-butyl)amino-7-p-chloroanilinofluoran
3,3-bis(p-dimethylaminophenyl)-6-dimethylamino-phthalide
3,3-bis(p-dimethylaminophenyl)phthalide
3-(p-dimethylaminophenyl)-3-(2 methylindole-3yl)phthalide
3-(p-dimethylaminophenyl)-3-(1,2 methylindole-3yl)phthalide
3,3-bis-(1,2-dimethylindole-3-yl)-5 triphdimethylaminophthalide
3,3-bis-(1,2 dimethylindole-3-yl)-6-dimethylaminophthalide
3,3-bis-(9-ethylcarbazole-3-yl)-5 dimethyl aminophthalide
3,3-bis(2-phenylindole-3-yl)-5-dimethylaminophthalide
3-p-dimethylaminophenyl-3-(1-methylpyrrole-2-yl)-6-dimethylaminophthalide N-halophenyl-leuco auramine
N-2,4,5-trichlorophenyl-leuco-auramine
rhodamine-B-anilinolactone rhodamine-(p-nitro-anilino)lactame 7-dimethyl-amino-2-methoxyfluoran
7-diethyl-3-methoxyfluoran
7-diethylamino-2-methoxyfluoran
7-diethylamino-3-chlorofluoran
7-diethylamino-3-chloro-2-methylfluroan
7-diethyl-2,3-dimethylfluoran
7-diethylamino-(3-acetylmethylamino)fluoran
7-diethylamino-(3-methylamino)fluorane
3,7-diethylaminofluoran
7-diethylamino-3-(dibenzylamino)fluoran
7-diethylamino-3-(methylbenzylamino)fluoran
7-diethylamino-3-(chloroelthylmethylamino) fluorane
7-diethylamino-3-(diethylamino)fluorane
2-phenylamino-3-methyl-6-(N-ethyl-N-p-tolyl) amino-fluoran
benzyol-leucomethylene blue
p-nitrobenzyl-leucomethylene blue
3-methyl-spiro-dinaphthopyran
3-ethyl-spiro-dinaphthopyran
3,3-dichloro-spiro-dinaphthopyran
3-benzyl-spiro-dinaphthopyran
3-methyl-naphtho-(3-methoxybenzo)-spiropyran
3-propyl-spiro-dibenzopyran
3-dibutylamino-6-methyl-7'-anilinofluoran
2-(2-chlorophenylamino)-6-diethylaminofluoran These compounds can be purchased from Hodogaya Chemical Company, Ltd., No. 1-4-2, Toranomon Mina-to-Ku, Tokyo, Japan. Other sources include Nachem, Inc., 25 Garden Park, Braintree, Mass., and Aldrich Chemical Co., 1001 W. St. Paul Avenue, Milwaukee, Wis. 53233.

Any compound that oxidizes the dye in the thermally reactive layer can be used as a thermal developer. Suitable thermal developers include:

p-octylphenol
p-tert-butylphenol
p-phenylphenol
1,1-bis(p-hydroxyphenyl)-2-ethyl butane
2,2-bis(p-hydroxyphenyl)propane
2,2-bis(p-hydroxyphenyl)pentane
2,2-bis(p-hydroxyphenyl)hexane
2,2-bis(4-hydroxy-3,5-dichlorophenyl)propane
p-hydroxybenzoic acid
ethyl p-hydroxybenzoate
butyl p-hydroxybenzoate
3,5-di-tert-butylsalicylic acid
3,5-di-$\alpha$-methylbenzylsalicylic acid
1,3-di-(o-trifloromethyl phenyl)thiourea
1,3-di-(m-trifloromethyl phenyl)thiourea
1,3-di-(p-trifloromethyl phenyl)thiourea
1,3-di-(o-chlorophenyl)thiourea
1,3-di-(m-chlorophenyl)thiourea
1,3-di-(p-chlorophenyl)thiourea
1,3-di-(o-methylphenyl)thiourea
1,3-di-(m-methylphenyl)thiourea
1,3-di-(p-methylphenyl)thiourea
1,3-di-(o-bromophenyl)thiourea
1,3-di-(m-bromophenyl)thiourea
1,3-di-(p-bromophenyl)thiourea
1,3-di-(o-ethylphenyl)thiourea
1,3-di-(m-ethylphenyl)thiourea
1,3-di-(p-ethylphenyl)thiourea
1,3-di-(p-isopropylphenyl)thiourea
1,3-di-(p-isobutylphenyl)thiourea
1,3-di-(p-isoamylphenyl)thiourea
1,3-di-(p-octylphenyl)thiourea
1,3-di-(p-laurylphenyl)thiourea
1,3-di-(p-styrylphenyl)thiourea
1,3-di-(p-methylcarbonylphenyl)thiourea
1,3-di-(p-isopropylcarbonylphenyl)thiourea
1,3-di-(p-diphenol)thiourea
1,3-diphenylthiourea
isopropylidene-4-4'diphenol(Bisphenol A)
benzotriazole
methyl-5-benzoatriazole
methyl-6-benzoatriazole phenyl-5-benzoatriazole
phenyl-6-benzoatriazole
chloro-5-benzoatriazole
chloro-5-methyl-6-benzoatriole
chloro-5-isopropyl-7-methyl-4-benzoatriole
bromo-5-benzoatriazole
nitro-4-benzoatriazole
nitro-5-benzoatriazole
nitro-5-dimethyl-4,7-benzoatriazole
dinitro-4,6-benzoatriazole
amino-4-benzoatriazole
amino-5-benzoatriazole
amino-5-methyl-6-benzoatriazole
amino-5-methyl-7-benzoatrizole
amino-5-chloro-4-benzoatrizole
amino-4-hydroxy-7-benzoatrizole
amino-7-carboxy-5-benzotriazole
diamino-4,5-benzotriazole
hydroxy-4-benzotriazole
diethoxy-4,7-benzotriazole
dihydroxy-4,5-benzotriazoyl-7-sulfonic acid
benzotriazolecarboxylic-5-acid Suitable basic thermal developers include the following structures:

BISPHENOLS

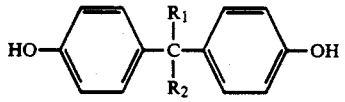

$R_1$, $R_2$ each represent a hydrogen atom or an alkyl group containing 1-12 carbon atoms or $R_1 + R_2$ combine to form an aliphatic carbocyclic ring.

THIOUREAS

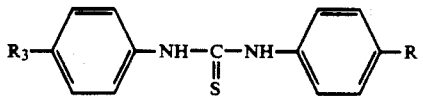

wherein $R_3 + R_4$ individually are hydrogen, halogen, alkyl, acyl, halogenated alkyl or an unsubstituted or unsubstituted aromatic group.

BENZOTRIAZOLE

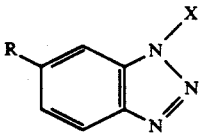

wherein R is a hydrogen, alkyl, aryl, nitro, halogen, amino, hydroxy, carboxyl, or sulfonic group.
X is a hydrogen or hydroxyl group.

Sources for thermal developers include: Aldrich Chemical Company, Inc., 940 W. St. Paul Avenue, Milwaukee, Wis. 53201, Dow Chemical Company, 2020 Willard H. Dow Center, Midland, Mich. 48674, and Hodogaya Chemical Co., Ltd., mentioned above.

The thermal developers preferably have a low-vapor pressure at temperatures below approximately 60° C. to prevent loss by evaporation during storage prior to use in the color forming process. They preferably also have a melting point between approximately 100°-170° C. The developers are preferably capable of liquefying or vaporizing at normal thermographic temperatures of approximately 150°-200° C. and combining with the essentially colorless coloring agents to produce an intensely colored image The developers also preferably do not cause background "fogging."

The coloring agent and the developer preferably exist in a dispersion which exhibits easy application, appropriate sensitivity to heat energy, durability, and aesthetic appeal. Accordingly, in a preferred embodiment, the thermal reactive layer is water based and includes not only the coloring agent and the thermal developer, but also an inorganic filler. More preferably, the water based thermal reactive layer includes a water based acrylic polymer varnish. The thermal reactive layer may also contain any or all of the following: a sensitizer, a pigment, a slip agent, an antifoam agent and a flow agent. Solvent-based thermal reactive layers may also be used, however.

A preferable inorganic filler includes calcium carbonate. Suitable inorganic fillers and their sources include:

calcium carbonate GA Marble Company 2575 Cumberland Parkway Atlanta, Ga. 30339
kaolin clay J. M. Huber Route 4 Macon, Ga. 31298
titanium dioxide Unocal 2275 Tucker Inn Blvd. Tucker, Ga. 30084
zinc sulfide "SACHTOLITH HD-5" Azalea Color 3021 Olympic Industrial Drive Smyrna, Ga. 30080
magnesium carbonate Georgia Marble Co. 2575 Cumberland Parkway Atlanta, Ga. 30339
soluble starch Aldrich Chemical Co., Inc. 1001 West St. Paul Avenue Milwaukee, Wis. 53233
talc Aldrich Chemical Co., Inc. 1001 West St. Paul Avenue Milwaukee, Wis. 53233
aluminum hydroxide Aldrich Chemical Co., Inc. 1001 West St. Paul Avenue Milwaukee, Wis. 53233

The inorganic filler should have an oil absorption rate of at least approximately 50 ml/100 g. It preferably has an average particle size of approximately 2-10 microns and more preferably 3 microns and should aid in increasing the whiteness and hence the contrast of the background. The filler should also act as a physical barrier between the color former and the thermal developer in the pre-printed stage. The filler should not exceed the weight of the color former by more than approximately three (3) times.

Water based acrylic polymer varnishes are preferable. Suitable varnishes and their sources include:

polyacrylamide Dow Chemical Co. 2020 Willard H. Dow Center Midland, Mich. 48674
polyvinyl pyrolidone GAF Chemicals Corporation 1361 Alps Road Wayne, N.J. 07470
polyvinyl alcohol Air Products & Chemicals Inc. 7201 Hamilton Blvd. Allentown, Pa. 18195
styrene maleic anhydride copolymer Monsanto Company 800 N. Lindbergh Blvd. St. Louis, Mo. 63167
ethylene maleic anhydride copolymer Monomer-Polymer and Dajar Laboratories, Inc. 36 Terry Drive Trevose, Pa. 19047
hydroxyethyl cellulose Hercules, Inc. Hercules Plaza - M/C Wilmington, Del. 19894
casein Ashland Chemical, Inc. Industrial Chemicals & Solvent Div. P.O. Box 2219 Columbus, Ohio 43216
carboxymethyl cellulose Browning Chemical Corporation 707 Westchester Avenue White Plains, N.Y. 10604
sodium polyacrylate Dixie Chemical Co. P.O. Box 130410 Houston, Tex. 77219
styrene butadiene emulsion Monomer-Polymer and Dajar Laboratories, Inc. 36 Terry Drive Trevose, Pa. 19047
styrene-acrylic copolymer Cork Industries, Inc. 500 Pine Avenue Holmes, Pa. 19043 vinyl chloride/vinyl acetate copolymer The Dow Chemical Co. 2020 Willard H. Dow Center Midland, Mich. 48674 polybutyl methacrylate Monomer-Polymer & Dajar Laboratories, Inc. 36 Terry Drive Trevose, Pa. 19047

The varnish serves as the vehicle that binds the color former, the thermal developer and the additional components to the substrate. Any varnish that fulfills this requirement is suitable. The components of the varnish preferably do not react with either the color former or the thermal developer. The varnish preferably does not produce large amounts of foam and preferably features excellent thermal conductivity. The final film produced by the varnish preferably possesses adequate strength for the integrity of the article.

A sensitizer can be used in combination with the thermal developer in order to take advantage of the eutectic phenomena. It lowers the melting point of the higher melting point thermal developer and thus reduces the radiant energy necessary to actuate the color forming process. Preferable sensitizers feature a melting point less than approximately 200° C., more preferably approximately 150° 1 C. or less.

A preferable sensitizer is zinc stearate, which can be obtained from Ashland Chemical, Inc., P.O. Box 2219, Columbus, Ohio 43216. Other suitable sensitizers include:

parafin wax Shell Chemical Co. One Shell Plaza Houston, Tex. 77002 polyolefinic waxes Ethyl Corporation Chemicals Group Ethyl Tower 451 Florida Baton Rouge, La. 70801 linoleic acid Henkel Corporation Emery Group 11501 Northlake Drive Cincinnati, Ohio 45249 glycol adipates Inolex High Performance Chemicals Jackson & Swanson Streets Philadelphia, Pa. 19148-3497 polyethylene wax Chemcentral Corporation P.O. Box 730 Bedford Park, Ill. 60499 beeswax Aldrich Chemical Co., Inc. 1001 W. St. Paul Avenue Milwaukee, Wis. 53233 carnauba wax Aldrich Chemical Co., Inc. 1001 W. St. Paul Avenue Milwaukee, Wis. 53233 montan wax Frank B. Ross Co., Inc. P.O. Box 4085 Jersey City, N.J. 07304

Fluorescent pigments can be used to lend to the thermal reactive coating a light color. The evenness of the gravure-applied thermal reactive coat across the web may thus be conveniently checked press-side. The fluorescent pigments allow use of a fluorescent light for particularly convenient, accurate and reliable monitoring of coating deposition during the printing process. Other light pigments may be used, however; alternatively, this pigment may be omitted.

Suitable pigments and their sources include:

Pigment 3206 U.S.R. Optimix Inc. Kings Highway Beattystown, N.J. 07840

2,2'(2,5-thiophenedyl)bis(5-tertbutylbenzoaxole) "fluorescent whitening agent" Ciba Geigy Corporation Additives Division Seven Skyline Drive Hawthorne, N.Y. 10532

A slip agent can be used to improve the properties of the thermal film. A suitable slip agent is any PTFE composition, preferably polytetrafluoroethylene (Teflon ®) available from, among others, Shamrock Technologies, Inc., Foot of Pacific Street, Newark, N.J. 07114. It remains on the surface of the dried thermal film and, because of its low coefficient of friction (0.05) and anti-stick properties, reduces the tendency of the thermal film to flake.

An antifoam agent can be used to eliminate the foam produced by air-agitated water based varnishes, in order to yield a smooth, evenly dispersed thermally reactive film.

Suitable antifoam agents and their sources include:

foam kill 649 Crucible Chemical Company P.O. Box 6786 Greenville, S.C. 27606

BYK-020 BYK-Chemie USA 524 South Cherry Street P.O. Box 5670 Wallingford, Conn. 06492

A suitable flow agent is Dow 57 additive, available from Dow Corning Corporation, Midland, Mich. 48686. The flow agent enhances the thermal coating's proper release from the gravure cylinder and allows an even spread over the substrate. The flow agent preferably does not exceed approximately 0.25% by weight of the total formulation.

Structures according to the present invention can be placed on substrate or stock such as promotional material, game pieces, lottery tickets, or any thin substrate which can be distributed and inserted in a radiant energy source. One such source is a Mecablitz flash unit model 60CT-4 provided by Metz-Werka GmbH and Co. of Germany. Any radiation source that provides sufficient radiant energy to heat the image layer of the articles and structures of the invention is appropriate, however.

The thermal reactive layer is typically the exposed layer of the structure. It must feature appropriate sensitivity in order to develop an image rapidly on exposure to a reasonable amount of radiant energy; it must not, however, continue to develop a nonimage (i.e., continue to oxidize) upon continued exposure to sunlight or ambient light. The image and nonimage must also be durable, so that game pieces or lottery tickets featuring the image can be redeemed without undue degradation a reasonable period of time after formation of the image in the thermal reactive layer. The layer or structure similarly must be resistant to humidity, grease, foods and stain agents which may be encountered at points of distribution such as fast food establishments They must be resistant to heat such as may be encountered in a closed automobile or other heated environment, and must be resistant to pressure such as that encountered in packaging for shipment to point of distribution. Additionally, the layers and structures should be comparable in durability to other conventional printed materials with respect to environments such as washing machines, parking lots, floors, and other potentially abusive environments. The images formed by the layers and structures should also, obviously, be attractive, clear, easily legible and aesthetically pleasing.

The inventors accomplish these goals using the thermal reactive layers described in this document, in combination with the other layers disclosed above, which may be applied via lithographic, flexographic, and gravure processes, and combinations thereof.

It is accordingly an object of the present invention to provide articles and structures that can be produced as commercial printing equipment flexographically, lithographically, via gravure offset or other techniques, and that display images upon exposure to radiant energy, using heat generated by a hidden image to form a corresponding image in the visible, thermal reactive layer.

It is another object of the present invention to provide a secure game piece or lottery ticket featuring information which remains hidden until the owner exposes the piece in a special device.

It is another object of the present invention to provide articles and structures featuring thermal reactive layers which generate images upon receipt of heat energy from hidden images, and which feature appropriate sensitivity to radiant energy, are visually attractive, are durable to ordinary wear and tear, and may be applied inexpensively and easily using conventional printing processes.

Other objects, features and advantages of the present invention are apparent with reference to the remainder of this document

DETAILED DESCRIPTION OF THE DRAWINGS

Figure 1:
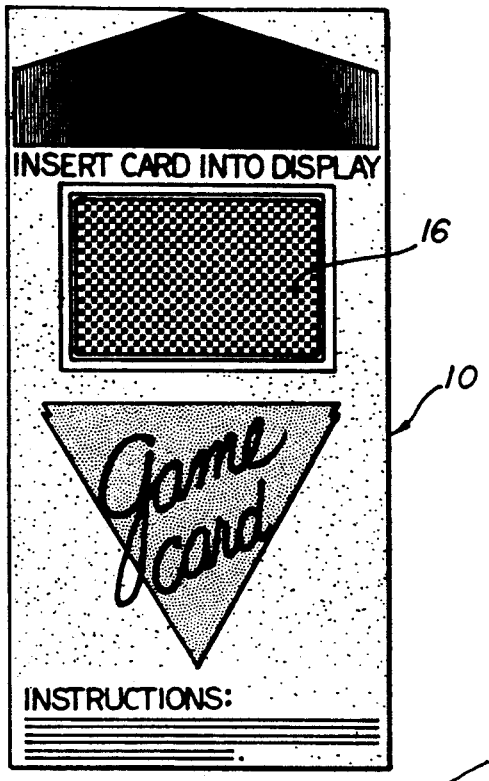
FIG. 1 is a perspective view of an article prepared according to a preferred embodiment of the present invention.
Figure 2:
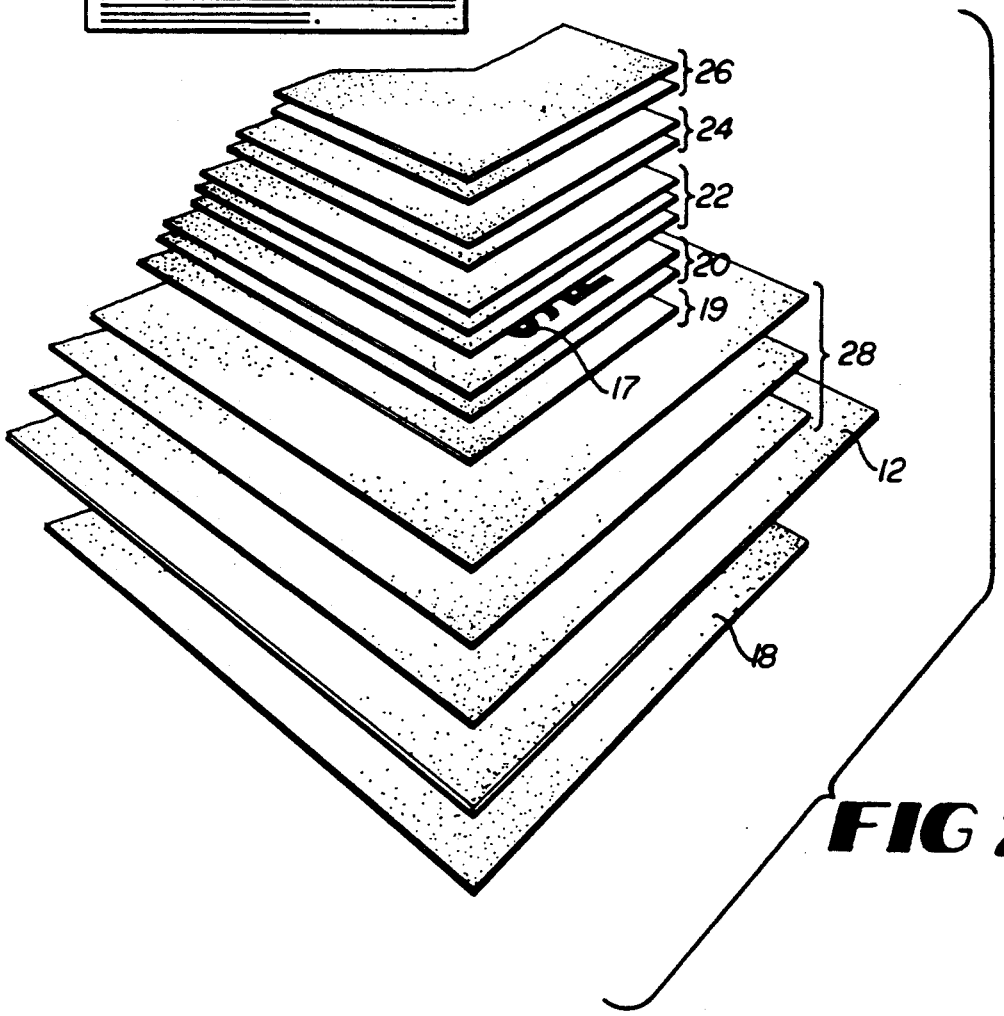
FIG. 2 is an exploded perspective view showing layers of the structure of the article shown in FIG. 1.

FIG. 1 shows an article prepared in accordance with a preferred embodiment of the present invention. The article may take the form of promotional material, a game piece, a lottery ticket, or any thin substrate, which may be distributed at retail establishments, fast food establishments, video rental locations and wherever else desired and which is desired to feature a hidden image which becomes exposed in the presence of a flash unit or other radiant energy.

Article 10 consists primarily of substrate or stock 12 and structure 14 according to the present invention. Substrate 12 may be any desired paper, cardstock, or other material, and may be coated on one side or both with any desirable coating or finish. In the preferred embodiment, substrate 12 is a coated one sided- or coated two sided-stock; more preferably, the stock is point.

Substrate 12 may include one or more reverse coatings 18 on the side of the substrate opposite to that on which the structure 14 appears. Reverse coatings 18 may be non-IR black or any other desired color inks that are preferably insensitive to heating via infrared light. Such coatings 18 may be conventional inks and may include confusion patterns, game instructions or other information or indicia.

Structure 14, applied on the image side of substrate 12, preferably includes one or more image layers 20, one or more obscuration layers 22, and one or more thermal reactive layers 26. (The image and, if desired, reverse side of substrate 12 may also feature graphic images formed of conventional colored ink layers 28 as desired.) The structure 14 may also include one or more overprint layers 24 between the thermal reactive layers 26 and the obscuration layers 22, if desired, in order to provide a lighter background for the thermal reactive layers 26.

Structure 14 also preferably includes a conventional sizing or "lily pad" layer 19 applied to the substrate 12. The sizing layer 19 helps eliminate flaking of subsequently applied lithographic inks and counters the propensity of gravure inks printed over lithographic inks to cause softening of resin in the lithographic inks. In effect, the sizing "accepts" the solvents of the later-applied gravure inks, to "lock" the entire system into place on the substrate 12.

The reverse coating or coatings 18 and the color layers 28 may be applied to the stock 12 before or after the sizing layer 19. These may be applied flexographically, lithographically or via gravure, and are not involved in the image area 16 of the structure, in the preferred embodiment.

The image layer or layers 20 are next preferably applied to the sizing layer 19. The image layers 20 may contain carbon black, iron oxide or other components which absorb radiant energy such as infrared radiation emitted from a flash unit or other desired device. The image layer 20 forms image 17, which when exposed to such radiant energy, emits or generates heat which is conducted to the thermal reactive layer or layers 26.

One or more image layers 20 may be applied using variable imaging, such as ink jet printers, in order to produce thermal reactive game pieces, security documents and other articles which each (or sets or subsets of which) bear a unique serial number or other indicia. Suitable equipment for such application of image layers 20 include Mead 2700 or 2800 ink jet imagers, for example.

One or more non-infrared sensitive black obscuration layers 22 are preferably applied over the image layer 20. One or more of those layers may be a "confusion" pattern to minimize the effects of high intensity light candling. These obscuration layers 22 are preferably formed of conventional "black" inks which contain no black pigments, but are simulated by mixing the three primary colors. The obscuration layers 22 accordingly appear black to the observer and thus provide a suitable mask for the hidden image, but permit transmission of desired wavelengths of radiant energy to the image layer 20. In the preferred embodiment, a solid and then a confusion obscuration layer is printed via lithographic, flexographic or gravure process, preferably followed by a gravure non-infrared sensitive "black" ink to mask the image further.

The thus far dark appearance of image area 16 is lightened in preparation for thermal reactive layers 26 using one or more overprint layers 24 of conventional preferably white or light overprint ink 24. These inks are preferably applied via a gravure or flexographic process for thickness, and preferably contain a conventional silicone-containing or hydrophilic compound that readily accepts the thermal reactive layers 26 which, in the preferred embodiment, are water based.

The thermal reactive layer or layers 26 are then applied over the overprint layers 24.

Structure 14 may be far simpler; sizing layer 19, obscuration layer 22, and/or overprint layers 24 may be eliminated, and these as well as image layer 20 and thermal reactive layer 26 may contain only one, or more if desired, layers of material. All of these may be applied as desired via flexographic, lithographic or gravure process, bearing in mind generally that gravure processes typically allow efficient and effective application of thicker layers.

Figure 3:
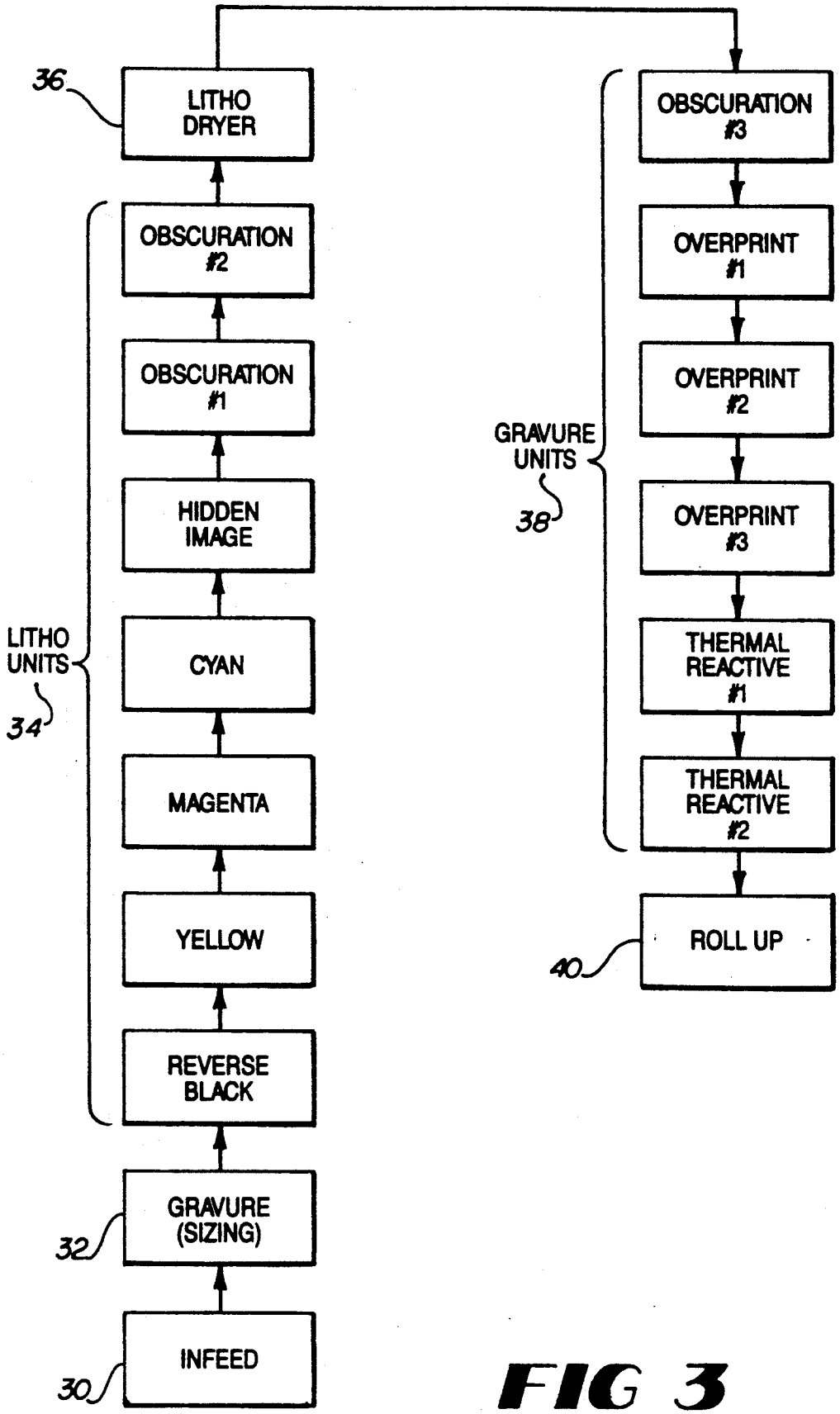
FIG. 3 is a schematic view of a production process according to the present invention.

FIG. 3 shows a schematic view of a process for applying a preferred embodiment of a structure 14 according to the present invention using conventional printing equipment. Generally, substrate 12 enters the process via infeed unit 30 and proceeds to a gravure unit 32 for application of sizing layer 19. Reverse coating 18, color layers 28, image layers 20 and two obscuration layers 22 are applied using lithographic units 34. A lithodryer 36 may then be used to dry the lithographically applied layers.

The substrate 12 then proceeds to gravure units 38 for application of the third obscuration layer 22, two overprint layers 24 and three thermal reactive layers 26. The substrate 12 then proceeds to roll-up unit 40.

The following Example I shows formulations for inks and materials of various layers of a preferred structure 14 according to the present invention. The components of the layers are provided by weight percent of the total composition and by ratio of volume.

EXAMPLE I

| Image Layer | | |
|---|---|---|
| Volume | Material | Weight |
| 1.59 | 5486-HLF, Var-Therm | 13.25 |
| 2.41 | Iovite HAS Gel Veh, 9-724 | 18.80 |
| 2.26 | Aliph.Hydrcarb. LV-3555 | 18.80 |
| 1.45 | Magiesol 47 | 9.65 |
| 3.66 | Super-Econotek, HW-5900 | 30.50 |
| 0.26 | Syloid 244 | 4.50 |
| 0.24 | Lin-All Manganese 6% | 2.00 |
| 0.06 | VCP-450 | 0.50 |

Sources for these materials are as follows:

5486-HLF heatset free flow instant squalene flush/-grind varnish Var-Chem Products, Inc. 300 Kuller Road Clifton, N.J. 07015

Iorite HAS Gel VEH 9-724 heatset gel vehicle containing a modified phenolic resin and an alkyd drying oil Iovite Inc. 21625 Oak Street Matteson, Ill. 60443 aliph hydrocarb LV-3555 aliphatic hydrocarbon solvent Lawter International 990 Skokie Blvd. Northbrook, Ill. 60062 magiesol 47 technical white hydrocarbon oil Magiesol Bros. Oil Co. 9101 Fullerton Avenue P.O. Box 1089 Franklin Park, Ill. 60131 super-econotek, HW-5900 hydrotreated petroleum distillate and carbon black Continental Dispersions, Inc. 830 Hawthorne, Lane West Chicago, Ill. 60185 syloid 244 silica gel, $SiO_2 \times H_2O$ W. R. Grace & Co. Davison Chemical Division 10 East Baltimore Street Baltimore, Md. 21203 lin-all manganese 6% manganese tallate 98% by weight Mooney Chemicals, Inc. 2301 Scranton Road Cleveland, Ohio 44113

VCP-450 anti oxidant Var-Chem Products 300 Kuller Road Clifton, N.J. 07015

| Lithographically Applied Obscuration Layer | | |
|---|---|---|
| Volume | Material | Weight |
| 0.56 | 5486-HLF, Var-Therm | 4.66 |
| 1.26 | Iovite HAS Gel Veh.Srp-241 | 10.47 |
| 1.26 | Iovite HAS Gel Veh. 9-724 | 9.82 |
| 1.36 | Magiesol 47 | 9.04 |
| 0.18 | Tridecylalcohol | 1.29 |
| 3.47 | 29-QV1443 Orange | 30.36 |
| 1.24 | Lithol Rubine Flush28H301 | 10.34 |
| 1.43 | Blue Flush, U49-2356 | 11.88 |
| 0.40 | Alkali Blue Flush,Red Sh. | 3.36 |
| 0.55 | U64-2357 Phthalo.Green | 4.59 |
| 0.22 | Lin-All Manganese 6% | 1.87 |
| 0.22 | Cobalt 12%,Cem-all Drier | 1.87 |
| 0.05 | VCP-450 | |

Sources for these materials are as follows:

5486-HLF heatset free flow varnish Var-Chem Products Inc. 300 Kuller Road Clifton, N.H. 07015

HAS GEL VSH SRP-241 hydrotreated petroleum distillate S. R. Premier, Inc. 150 S. Fairbanks Streets Addison, Ill. 60101

9-724 heatset gel vehicle containing a modified penolic resin and an alkyl drying oil Iovite, Inc. (IOVITE) 21625 Oak Street Matteson, Ill. 60443 magiesol 47 petroleum based technical white oil Magie Bros. Oil Co. 9101 Fullerton Avenue P.O. Box 1089 Franklin Park, Ill. 60131-1089 tridecylalcohol ICI Americas, Inc. Wilmington, Del. 19897 hydrocarbon petroleum distillate and ÷Orange pigment 13 flush BASF Corporation—Chemicals Division 100 Cherry Hill Road Parsippany, N.J. 07054

284301 rubine red hydrotreated petroleum distillate and ci pigment red 57 flush Hilton Davie Co. 2235 Langdon Farm Road Cincinnati, Ohio 45237 green shade phthalo blue pigment flushed in polyversyl multi purpose petroleum distillate vehicle Sun Chemical Corporation—Pigments Division 4526 Chickering Avenue Cincinnati, Ohio 45232-1984 alkali blue hydrotreated petroleum distillate and blue pigment 61 CI #42765: 1 flush PMC Specialties Group 735 East 115th Street Chicago, Ill. 60628 u64-2357 hydrotreated petroleum distillate and phthalocyanine green pigment flush Sun Chemical Corporation 4526 Chickering Avenue Cincinnati, Ohio 45232 lin-all manganese 6% manganese tallate 98% by weight Mooney Chemicals, Inc. 2301 Scranton Road Cleveland, Ohio 44113 cobalt 12% cobalt carboxylate mixture 76% by weight Mooney Chemicals, Inc. 2301 Scranton Road Cleveland, Ohio 44113 vcp-450 anti-oxidant, anti-skinning agent Var-Chem Products 300 Kuller Road Clifton, N.J. 07015

| Gravure Applied Obscuration Layer | | |
|---|---|---|
| Volume | Material | Weight |
| 5.02 | Ethanol (Ethyl Alcohol) | 33.45 |
| 0.63 | Propylene Glycol Ether | 4.80 |
| 0.97 | SMA AG-1735 Resin | 9.60 |
| 0.76 | Nitrocellulose Solution | 6.70 |
| 1.07 | Resinall 833 | 9.60 |
| 0.43 | 2BYS Chip 7-1104 | 6.70 |
| 1.58 | Process Blue 7-1089 | 13.20 |
| 0.80 | 71090 P.R. Yellow | 6.70 |
| 1.23 | Ethyl Acetate 99.5% | 9.25 |

Sources for these materials are as follows:

ethanol oxygenated solvent blend—ethyl alcohol (200 proof) 84.7% Shell Oil Company P.O. Box 4320 Houston, Tex. 77210 propylene glycol ether Ashland Chemical Company P.O. Box 2219 Columbus, Ohio 43216 sma-ag-1735 ester/styrene maleic anhydride copolymer ATOCHEM North America Polymers Division 1112 Lincoln Road Birdsboro, Pa. 19508 nitrocellulose solution Scholle Corporation 200 West North Avenue Northlake, Ill. 60164 resinall 833 rosin modified maleic resin Resinall Corporation High Ridge Road Stanford, Conn. 06905 lbys chip 7-1104 cid red 48, 1 pigment Arcograph, Inc. Aux Rt. 2 Montrose, Minn. 55363

7-1089 cid blue 15.3 pigment Arcograph, Inc. Aux Rt. 2 Montrose, Minn. 55363

71090 cid yellow 14 pigment Arcograph, Inc. Aux Rt. 2 Montrose, Minn. 55363 ethyl acetate 99.5% Union Carbide Corporation 39 Old Ridgebury Road Danbury, Conn. 06817-0001

| Volume | Overprint Layers<br>Material | Weight |
|---|---|---|
| 4.47 | Methyl Ethyl Ketone | 30.00 |
| 3.99 | Ethyl Acetate 99.5% | 30.00 |
| 1.92 | VMCA Vinyl Resin | 21.50 |
| | Cut in and add: | |
| 0.43 | Titanox 2160, Titanium Dioxide | 14.25 |
| 0.24 | Syloid 244 | 4.25 |

Sources for these materials are as follows:

methyl ethyl ketone Ashland Chemical Company P.O. Box 2219 Columbus, Ohio 43216 ethyl acetate 99.5% Union Carbide Corporation 39 Old Ridgebury Road Danbury, Conn. 06817-0001 vinyl resin vinyl chloride—vinyl acetate—maleic acid terpolymer Union Carbide Chemicals & Plastics Company 39 Old Ridgebury Road Danbury, Conn. 06817-0001 titanox 2160 titanium dioxide NL Industries, Inc. Environmental Control Dept. P.O. Box 1090 Wycoff Mills Road Hightstown, N.J. 08520 syloid 244 synthetic amorphous silica W. R. Grace & Co. P.O. Box 2117 Baltimore, Md. 21203

| Volume | Thermal Reactive Layer<br>Material | Weight |
|---|---|---|
| 6.43 | Watervarnish,CK-72H | 55.90 |
| 0.98 | Thermal Developer | 8.20 |
| 0.06 | Fluorescent Pigment 3206 | 0.50 |
| 0.27 | Gamma Sperse | 6.00 |
| 0.48 | Zinc Stearate, GPSF, 5895 | 4.00 |
| 0.12 | SST-2 | 1.00 |
| 0.68 | Water | 5.70 |
| 0.03 | Anti-Foam 649M.S. | 0.25 |
| | Solution: | |
| 0.20 | Dow Corning 57 Additive | 0.20 |
| 0.11 | Water | 0.90 |
| | Grind; Shot Mill | |
| 1.26 | Watervarnish,CK-72H | 11.00 |
| 0.44 | Thermal Dye | 3.65 |
| 0.32 | Water | 2.70 |

Sources for these materials are as follows:

ck-72H "cork-kote" styrene/acrylic polymer Cork Industries, Inc. 500 Pine Avenue Holmes, Pa. 19043 thermal developer tha-50 bisphenol Derivative Hodogaya Chemical Co. Ltd. No. 1-4-2Toranomon Minato-Ku Tokyo, Japan fluorescent pigment cadmium sulfide U.S.R. Optomix, Inc. Kings Highway Beattystown, N.J. 07840 gamma sperse calcium carbonate Georgia Marble Company 2575 Cumberland Parkway Atlanta, Ga. 30339 zinc stearate stearic acid zinc salt Mallinckrodt, Inc. P.O. Box 5439 St. Louis, Mo. 63147 sst-2 polytetrafluoroethylene Shamrock Chemicals Corporation Foot of Pacific Street Newark, N.J. 07114 anti-foam 649 MS petroleum hydrocarbon Crucible Chemical Company P.O. Box 6786 Greenville, S.C. 29606 dow 57 silicone glycol Dow Corning Corporation Midland, Mich. 48686 thermal dye Spiro [isobenzofuran-1(3H), 9'-[9H]xanthen]-3-one,6' [ethyl[(tetrahydro-2-furanyl)methyl-]amino]-3'-methyl-2'- (phenylamino)Hodogaya Chemical Co. Ltd. No. 1-4-2 Toranomon Minato-Ku Tokyo, Japan Other leuco dyes in the preferred embodiment are sold under the trade name "CF-51" by Nachem, Inc., 25 Garden Park, Braintree, Mass. and have the generic chemical name, spiro[isobenzofuran-1(3H), 9'-[9H]xanthen]-3-one, 6'[ethyl[(tetrahydro-2-furanyl)methyl-]amino]-3'-methyl-2'-(phenylamino)-. Another alternative leuco dye is sold under the trade name "CF-51" by Hodogaya Chemical Company, Limited, Tokyo, Japan and is generically known as 2'-phenylamino-3'-substituted-6'-substituted amino-spiro[isobenzofuran-2(3H), 9'[9H]xanthen]-3-one.

The thermal developer in this example is sold under the trade name THA-50 by Hodogaya Chemical Co., Ltd. and is a bisphenol derivative ($C_{15}H_{14}O_4$).

The water varnish is a modified acrylic composition sold under the trade name "Cork-Kote 72H" by Cork Industries, Inc., 500 Pine Avenue, Holmes, Pa. 19043.

The inorganic filler is preferably calcium carbonate and may also be provided by J. M. Huber Corporation, 3150 Gardener Expressway, Quincy, Ill. 62305 under the name "Huber Carb." The sensitivity agent is preferably zinc stearate sold by Mallinckrodt, Inc., P.O. Box 5439, St. Louis, Mo., 63147. The florescent pigment is sold under the name "Pigment 3206" by U.S.R. Optimix, Inc., Kings Highway, Beattystown, N.J. 07840. The slip agent is preferably a polytetrafluorethylene composition sold under the name "SST-2" by Shamrock Chemicals Corp., Foot of Pacific Street, Newark, N.J. 07114, while a suitable antifoam agent is also sold under the trade name "Foam Kill 649" by Crucible Chemical Company, P.O. Box 6786, Greenville, S.C. 27606.

Suitable formulations for the thermal reactive layer (by weight percentages) also include:

| FORMULATION A | Weight % |
|---|---|
| Water Varnish, CK-724 | 60.0% |
| Bisphenol A (thermal developer) | 3.0% * |
| Fluorescent Pigment | 0.15% |
| Kaolin Clay | 6.00% ** |
| Zinc Stearate | 4.00% |
| Teflon SST-2 | 1.00% |
| Water | 6.00% |
| Anti-foam | 0.25% |
| Dow Corning 57 solution | 0.20% |
| Water (Grind Shot Mill) | 1.00% |
| Water Varnish | 11.40% |
| Thermal Dye | 3.00% |
| Water (Grind Shot Mill) (gives black image) | 3.00% |

Sources for asterisked materials (not already listed above) are as follows:
* Thermal Developer
Bisphenol A
Dow Chemical Corporation
Midland, MI 48686
** Kaolin Clay
J. M. Huber
Route 4
Macon, GA 31298

| FORMULATION B | by weight % |
|---|---|
| Water Varnish Joncryl 138 | 21.4% * |
| Thermal Developer (p-phenyl phenol) | 8.0% ** |
| Let Down Varnish (Joncryl 89) Water | 39.5% *** |
| Gamma Sperse Grind | 12.6% |

-continued

| FORMULATION B | by weight % |
|---|---|
| Thermal Dye (Crystal Violet Lactone) | 2.2% |
| Water Varnish (Joncryl 138) | 5.8% |
| Water | 4.5% |
| Grind (gives Blue image) | |

Sources for asterisked materials are as follows:
* Joncryl 138
Acrylic polymer emulsion
Johnson Wax Specialty Chemicals
1525 Howe Street - Sta #095
Racine, Wisconsin 53403-5011
** Thermal Developer
p-phenyl phenol
Aldrich Chemical Co.
1001 West St. Paul Avenue
Milwaukee, WI 53233
*** Joncryl 89
Styrenated Acrylic Polymer Emulsion
Johnson Wax Specialty Chemicals
1525 Howe Street - Sta #095
Racine, Wisconsin 53403-5011
**** Thermal Dye
Crystal Violet Lactone
Aldrich Chemical Co.
1001 West St. Paul Avenue
Milwaukee, WI 53233
6-(dimethylamino)-3,3-bis(4-dimethylamino) phenyl)-1(3H)-isobenzofuranone

| FORMULATION C | | by weight % |
|---|---|---|
| Water Varnish CK-724 | | 57.65% |
| Thermal Developer (bisphenol A) | | 6.40% |
| Fluorescent Pigment | | 0.15% |
| Gamma Sperse | | 6.20% |
| Zinc Stearate | | 4.10% |
| SST-2 | | 1.05% |
| Water | | 6.00% |
| Anti Foam BYK-020 | | 0.25%* |
| 57 Additive | solution | 0.20% |
| Water | solution | 0.95% |
| (Grind; shot mill) | | |
| Water Varnish CK-724 | | 11.40% |
| Thermal Dye (TH-108) | | 2.90%** |
| Water (Grind) | | 2.75% |
| (Gives black image) | | |

Sources for asterisked materials are as follows:
*antifoam
BYK-202
BYK Chemie USA
524 South Cherry Street
P. O. Box 5670
Wallingford, CT 06492
**thermal dye
TH-108
3-dibutylamino-6'-methyl-7'-anilinofluoran
Hodogaya Chemical Co. Ltd.
No. 1-4-2 Toranomon Minato-Ku
Tokyo, Japan

| FORMULATION D | | by Weight % |
|---|---|---|
| Water Varnish CK-724 | | 57.65% |
| Thermal Developer | | 6.40% |
| Fluorescent Pigment (Ciba-Geigy Corp.) | | 0.15%* |
| Gamma Sperse | | 6.20% |
| Linoleic Acid | | 4.10%** |
| SST-2 | | 1.05% |
| Water | | 6.00% |
| Antifoam-649B.S. | | 0.25% |
| Dow 57 | solution | 0.20% |
| Water | solution | 0.95% |

-continued

| FORMULATION D | by Weight % |
|---|---|
| (Grind; Shot Mill) | |
| Water Varnish CK-724 | 11.40% |
| Thermal Dye (TH-107) | 2.90%*** |
| Water | 7.75% |
| Grind; Shot Mill (Gives Black Image) | |

Sources for asterisked materials are as follows:
*Fluorescent Pigment
2,2'(2,5-thio-phenyl)bis(5-tert-butylbenzoxazole)
Ciba Geigy Corporation
Additives Division
Seven Skyline Drive
Hawthorne, N.Y. 10532
**Linoleic Acid
Henkel Corporation
Emery Group
11501 Northlake Drive
Cincinnati, OH 45249
***Thermal Dye
TH-107
2-(2-chlorophenylamino)-6-diethylaminofluoran
Hodogaya Chemical Co. Ltd.
No. 1-4-2 Toranomon Minato-Ku
Tokyo, Japan

| FORMULATION E | by Weight % |
|---|---|
| Water Varnish (5% polyvinyl alcohol (AQ)) | 58.0%* |
| Thermal Developer (Bisphenol A) | 3.9% |
| Octadecanamide (sensitizer) | 3.9%** |
| Gamma Sperse | 7.8% |
| Anti-Foam (Grind; Shot Mill) | 0.09% |
| Water Varnish (5% polyvinyl alcohol) | 25.03% |
| Thermal Dye (crystal violet lactone) | 1.20% |
| Dow 57 (Grind; Shot Mill) | 0.08 |
| (Blue image) | |

Sources for asterisked materials are as follows:
*Polyvinyl Alcohol
Aldrich Chemical Co., Inc.
1001 West St. Paul Avenue
Milwaukee, WI 53233
**Octadecanamide
Aldrich Chemical Co., Inc.

EXAMPLE II

The structure 14 consists of layers according to Example I, together with a reverse coating 18, conventional yellow, magenta and cyan color layers 28 and a conventional sizing layer 19 were applied using the process shown in FIG. 3 on 8 point stock to product game pieces as shown in FIG. 1. The game pieces exhibited excellent sensitivity, durability, aesthetic, ease of manufacture and cost characteristics. The gamepieces were exposed in flash units at point of sale in a major video rental chain with favorable acceptance by consumers and the customer.

EXAMPLE III

A second structure 14 was prepared using the following structure of layers as formulated in Example I, except as noted.

1 Sizing Layer
1 Hidden Image IR Black
2 Obscuration Layers
1 Gravure Obscuration Layer
1 PC5D-5965 White 1 PC6P-6111 Lily Pad
1 Thermal Reactive Coat PC6D-5965 is an acrylic white display ink containing 10% more titanium dioxide than the previous white layer. This increases the whiteness of the play area and hence the contrast of the finished image.

EXAMPLE IV

A third structure 14 was prepared according to a sheetfed (offset) thermal system, using the following format in the following order:

| | |
|---|---|
| H.I. Black conventional sheet fed Ink (carbon-IR) | |
| 2 layers conventional Non-IR black obscuration | |
| 3 layers conventional O/S white ink | |
| 2 layers thermal offset coat prepared by mixing the following components by weight %: | |
| 58-0501 | 17% |
| 61-0001 | 2% |
| 61-0004 | 2% |
| 10-0080 | 6% |
| 56-0051 | 13% |
| 10-5895 | 4% |
| 58-0662 | 40% |
| Grind Thru Mill | |
| 50-0051 | 6% |
| 58-0662 | 5% |
| 58-0501 | 4% |
| Grind Thru Mill | |

The thermal offset coat components and their sources are as follows:

58-0501 hydrotreated petroleum distillate—low tack Glass Gel Vehicle S. R. Premier, Inc. 150 S. Fairbanks Street Addison, Ill. 60101

61-0001 manganese tallate—98% by weight Mooney Chemicals, Inc. 2301 Scranton Road Cleveland, Ohio 44113

61-0004 cobalt tallate 92% by weight Mooney Chemicals, Inc. 2301 Scranton Road Cleveland, Ohio 44113

10-0080 gamma sperse Calcium Carbonate Georgia Marble Company 2575 Cumberland Parkway Atlanta, Ga. 30339 thermal developer 56-0051 THA 50 Hodogaya Chemical Co., Ltd. No. 1-4-2 Toranomon Minato-ku Tokyo, Japan 60-0002 PTFE (Teflon®) Shamrock Chemicals Corporation Foot of Pacific Street Newark, N.J. 07114

10-5895 zinc stearate Mallinckrodt, Inc. P.O. Box 5439 St. Louis, Mo. 63147

58-0662 oleoresinous printing ink vehicle AK20 Resins & Vehicles 21625 Oak St. Matteson, Ill. 60443

50-0051 thermal dye CF-51 Nachem, Inc. 25 Garden Park Braintree, Mass. 02184 spiro[isobenzofuran-1(3H), 9'-[9H]xanthen]-3-one,6'-[ethyl[(tetrahydro-2-furanyl)methyl]amino]-3'-methyl-2'-(phenylamino)- or

CF-51 Hodogaya Chemical Co., Ltd. No. 1-4-2 Toranomon Minato-ku Tokyo, Japan 2'-phenylamino-3'-substituted-6'-substituted amino-spiro[isobenzofuran-1(3H),9'[9H]xanthen]-3-one This system can be printed on a sheetfed press—the layers 1-3 above are standard offset inks.

EXAMPLE V

The following is a solvent-based thermal coating, very intensely colored black when developed thermally, which requires the use of only one gravure cylinder for its application as opposed to the typical three with the water based ones. Flow and antifoam agents are not required as this is a non-aqueous system; cell dry-in should not be a problem. Sensitizers are not needed as the polyamide resin appears to be an excellent thermal conductor in its own right.

| | | |
|---|---|---|
| 54-4084 | Ethanol | 38.7% |
| 54-0004 | Lactol Spirits | 13.9% |
| 56-1074 | Polyamide Resin | 7.0% |
| 56-0833 | Maleic Resin | 7.0% |
| 56-0050 | Bisphenol A | 10.2% |
| 99-7600 | Fluor. Pigment | 0.2% |
| 60-0002 | Teflon | 1.0% |

Adjust the pH with Ammonium Hydroxide until it is 9.5 to 10. This step is critical to the process. Grind through shot mill (although this may be unneeded due to Bisphenol A's solubility in ethanol)

| | | |
|---|---|---|
| 54-4084 | Ethanol | 14.0% |
| TH-107 | Thermal Dye | 8.0% |

Adjust pH to 9.5-10.0 with ammonium hydroxide and grind through the shot mill. Cool to 70°-75° F. Combine with the solution above.

This provides an inexpensive, easier-to-clean up, and perhaps more thermally responsive system than some water based systems.

The foregoing has been provided for purposes and illustration and explanation of a preferred embodiment of the present invention. Modifications and adaptations may be made to the embodiments described above without departing from the scope or spirit of the invention.

What is claimed is:

1. A structure which features an image upon exposure to radiant energy, comprising:

(a) a sizing layer;

(b) at least one image layer featuring an image that comprises material which, when exposed to the radiant energy, generates heat;

(c) at least one obscuration layer which is penetrable by a portion of the radiant energy, but which obscures observation of the image layer;

(d) at least one layer of overprint ink which is penetrable by a portion of the radiant energy; and (e) at least one thermal reactive layer placed over the image layer, which thermal reactive layer is penetrable by a portion of the radiant energy and which comprises: (i) a coloring agent which is oxidized to change color in order to reveal the image; and (ii) an oxidizing agent that oxidizes the coloring agent in the presence of heat.

2. A structure according to claim 1 in which the obscuration layer is formed of ink of the three primary colors.

3. A structure which features an image upon exposure to radiant energy, comprising:

(a) a sizing layer;

(b) at least one image layer featuring an image that comprises material which, when exposed to the radiant energy, generates heat;

(c) at least one obscuration layer formed of ink of the three primary colors, which layer is penetrable by a portion of the radiant energy, but obscures observation of the image layer;

(d) at least one layer of overprint ink which is penetrable by a portion of the radiant energy; and (e) at least one thermal reactive layer which is placed over the image layer, which thermal reactive layer is penetrable by a portion of the radiant energy, and which comprises: (i) a coloring agent which is oxidized to change color in order to reveal the image; (ii) an oxidizing agent that oxidizes the coloring agent in the presence of heat; (iii) an inorganic filler; and (iv) a varnish.

4. A structure which features an image upon exposure to radiant energy, comprising:

(a) a sizing layer;

(b) at least one image layer featuring an image that comprises a material which, when exposed to the radiant energy, generates heat;

(c) at least one obscuration layer comprising inks of the three primary colors, which layer is penetrable by a portion of the radiant energy, but obscures observation of the image layer;

(d) at least one layer of overprint ink which is penetrable by a portion of the radiant energy; and (e) at least one thermal reactive layer which is penetrable by a portion of the radiant energy, which generates an image corresponding to the hidden image when exposed to heat from the image, and which comprises (1) a thermal developer;

(2) a leuco dye;

(3) a varnish;

(4) a sensitizer;

(5) an inorganic filler comprising calcium carbonate;

(6) a slip agent containing a fluorocarbon;

(7) a fluorescent pigment; and a flow agent.

5. An article which features an image upon exposure to radiant energy, comprising a substrate to which is applied a structure that comprises:

(a) at least one image layer featuring an image that comprises a material which, when exposed to the radiant energy, generates heat;

(b) at least one obscuration layer comprising inks of the three primary colors, which layer is penetrable by a portion of the radiant energy, but obscures observation of the image layer; and (c) at least one thermal reactive layer which is placed over the image layer, which thermal reactive layer is penetrable by a portion of the radiant energy, and which comprises: (i) a coloring agent which is oxidized to change color in order to reveal the image; (ii) an oxidizing agent that oxidizes the coloring agent in the presence of heat; and (iii) a varnish.

6. An article which features an image upon exposure to radiant energy, comprising a substrate to which is applied a structure that comprises:

(a) a sizing layer;

(b) at least one image layer featuring an image that comprises material which, when exposed to the radiant energy, generates heat;

(c) at least one obscuration layer comprising inks of the three primary colors, which layer is penetrable by a portion of the radiant energy, but obscures observation of the image layer;

(d) at least one layer of overprint ink which is penetrable by a portion of the radiant energy; and (e) at least one thermal reactive layer which is placed over the image layer, which thermal reactive layer is penetrable by a portion of the radiant energy, and which comprises: (i) a coloring agent which is oxidized to change color in order to reveal the image; (ii) an oxidizing agent that oxidizes the coloring agent in the presence of heat; (iii) an inorganic filler; and (iv) a varnish.

7. An article according to claim 6 in which the thermal reactive layer further comprises a sensitizer which includes zinc stearate.

8. An article according to claim 6 in which the thermal reactive layer further includes an inorganic filler that includes calcium carbonate.

9. An article which features an image upon exposure to radiant energy, comprising a substrate to which is applied a structure that in turn comprises:

(a) a sizing layer;

(b) at least one image layer featuring an image that comprises a material which, when exposed to the radiant energy, generates heat;

(c) at least one obscuration layer comprising inks of the three primary colors, which layer is penetrable by a portion of the radiant energy, but obscures observation of the image layer;

(d) at least one layer of overprint ink which is penetrable by a portion of the radiant energy; and (e) at least one thermal reactive layer which is penetrable by a portion of the radiant energy, which generates an image corresponding to the image when exposed to heat from the image, and which comprises (1) a thermal developer;

(2) a leuco dye;

(3) a varnish;

(4) a sensitizer;

(5) an inorganic filler comprising calcium carbonate;

(6) a slip agent containing a fluorocarbon;

(7) a fluorescent pigment; and a flow agent.

10. A structure which features an image upon exposure to radiant energy that comprises:

(a) at least one image layer featuring an image that comprises a material which, when exposed to the radiant energy, generates heat;

(b) at least one obscuration layer comprising inks of the three primary colors, which layer is penetrable by a portion of the radiant energy, but obscures observation of the image layer; and (c) at least one thermal reactive layer which is placed over the image layer, which thermal reactive layer is penetrable by a portion of the radiant energy, and which comprises: (i) a coloring agent which is oxidized to change color in order to reveal the image; and (ii) an oxidizing agent that oxidizes the coloring agent in the presence of heat.

11. The article of claim 5, wherein the material comprises carbon black.

12. The structure of claim 10, wherein the material is carbon black.

* * * * *

UNITED STATES PATENT AND TRADEMARK OFFICE

CERTIFICATE OF CORRECTION

PATENT NO. : 5,234,798

DATED : August 10, 1993

INVENTOR(S) : Bryne E. Heninger, Donna C. Stimpson, and Stephen M. Ems

It is certified that error appears in the above-identified patent and that said Letters Patent is hereby corrected as shown below:

Column 2, line 52, delete the first occurrence of the word "a" and insert --an-- therefor Column 3, at approximately line 49, delete all extraneous spaces before the word "triphdime-"

Column 3, at approximately line 57, the following belongs on the next line: "N-halophenyl-leuco aura-" and should be placed before the word "mine" on line 58

Column 3, at approximately line 60, the following belongs on the next line: "rhodamine-(p-nitro-" and should be placed before the word "anilino)lactame" on line 61

Column 3, at approximately line 61, the following should start a new line: "7-dimethyl-amino-2-methoxyfluoran"

Column 5, beginning at line 35, in the equation for THIOUREAS the second occurrence of "R" should read "$R_4$"

Column 5, line 65, delete the period after "C"

Column 5, line 67, insert a period after the word "image"

Column 7, line 22, delete the period after "C"

UNITED STATES PATENT AND TRADEMARK OFFICE

CERTIFICATE OF CORRECTION

PATENT NO. : 5,234,798

DATED : August 10, 1993

INVENTOR(S) : Bryne E. Heninger, Donna C. Stimpson, and Stephen M. Ems

It is certified that error appears in the above-identified patent and that said Letters Patent is hereby corrected as shown below:

Column 7, line 23, delete the period after "C"

Column 8, actual line 42 (by counting, as opposed to printed line number), insert a period after the word "establishments"

Column 9, line 42, before the word "point" insert --8--

Column 13, line 68, delete all extraneous spaces between -2'- and (phenylamino); insert "-" after "(phenylamino)"

Column 14, line 7, delete all extraneous spaces after "then]-3-one,"

Column 14, line 12, delete all extraneous spaces after "ed-6'-substituted"

Column 16, line 48, delete the word "consists" and insert --consisting-- therefor Column 17, in the chart under EXAMPLE IV between numbered lines 20 and 25, a line has been left out of the chart and should be inserted after the line that reads "56-0051 13%" as follows: --60-0002 1%--

UNITED STATES PATENT AND TRADEMARK OFFICE

CERTIFICATE OF CORRECTION

PATENT NO. : 5,234,798

DATED : August 10, 1993

INVENTOR(S) : Bryne E. Heninger, Donna C. Stimpson, and Stephen M. Ems

It is certified that error appears in the above-identified patent and that said Letters Patent is hereby corrected as shown below:

Column 17, line 54, delete all extraneous spaces after "spiro[isobenzofuran-1(3H),"

Column 17, line 60, delete all extraneous spaces after "stituted-6'-substituted"

Signed and Sealed this

Nineteenth Day of July, 1994

*Attest:*

Bruce Lehman

BRUCE LEHMAN

*Attesting Officer*

*Commissioner of Patents and Trademarks*